United States Patent [19]

Sawyer

[11] Patent Number: 4,875,678

[45] Date of Patent: Oct. 24, 1989

[54] BALL RETRIEVAL SYSTEM

[76] Inventor: Hermon R. Sawyer, P.O. Box 60344, Palo Alto, Calif. 94306

[21] Appl. No.: 187,451

[22] Filed: Apr. 28, 1988

[51] Int. Cl.[4] ..... A63B 61/00

[52] U.S. Cl. ..... 273/30

[58] Field of Search ..... 273/29 R, 29 A, 201, 273/202, 30, 26 D, 179 D, 182 R, 182 A; 124/56, 51 A; 406/81, 151, 93, 94, 98, 106, 137, 194, 198, 181

[56] References Cited

U.S. PATENT DOCUMENTS

| | | | |
|---|---|---|---|
| 684,152 | 10/1901 | Wheildon | 406/106 |
| 1,272,794 | 7/1918 | Girtanner | 406/194 |
| 1,899,706 | 2/1933 | McClean | 273/86 D |
| 2,630,320 | 3/1953 | France | 273/86 D |
| 2,778,692 | 1/1957 | Makinson | 406/93 |
| 3,260,527 | 7/1966 | Younce | 273/179 D |
| 3,314,679 | 4/1967 | Kolln | 273/176 K |
| 3,339,924 | 9/1967 | Costagliona | 273/86 D |
| 3,567,223 | 3/1971 | Gentiluomo | 273/201 |
| 3,599,980 | 8/1971 | Harmond et al. | 273/179 D |
| 4,004,806 | 1/1977 | Malik | 273/29 R |
| 4,212,284 | 7/1980 | Speer | 124/56 |
| 4,272,078 | 6/1981 | Vinette | 124/56 |
| 4,291,665 | 9/1981 | Bash | 273/29 A |

*Primary Examiner*—T. Brown

*Attorney, Agent, or Firm*—Flehr, Hohbach, Test, Albritton & Herbert

[57] ABSTRACT

System for retrieving balls outside the normal playing area of a game such as table tennis or the like. The system includes a channel for receiving the balls to be retrieved, a ball receptor in a convenient location of the playing area, and a circulating air system for conveying the balls along the channel and from the channel to the receptor. A blower is provided to draw balls through a duct and into the receptor and to propel the balls along the channel to a transfer point where the balls will move from the channel and into the duct.

14 Claims, 2 Drawing Sheets

Fig. 4
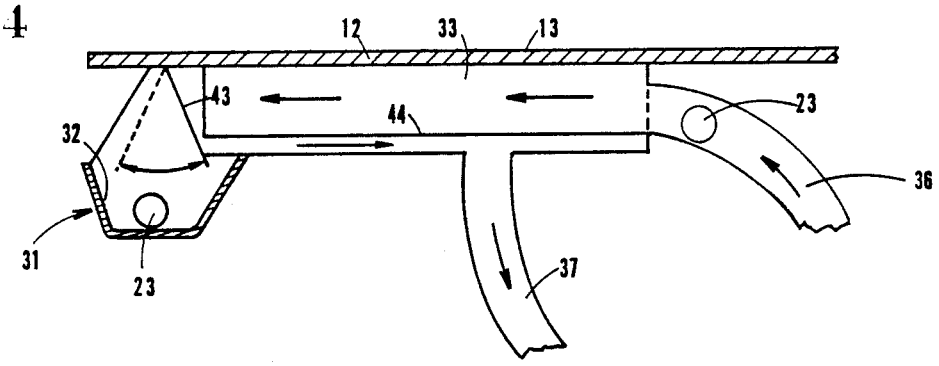
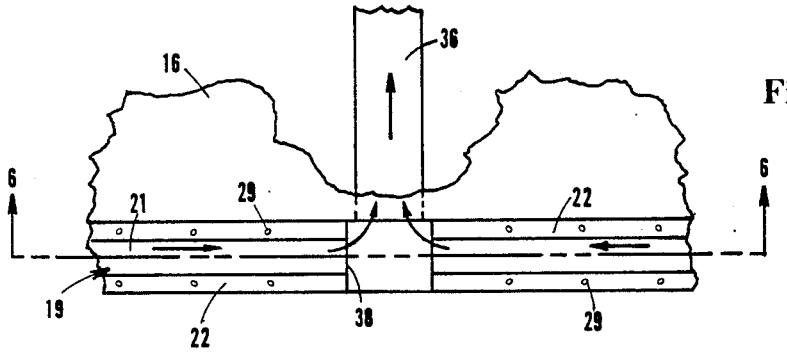
Fig. 5
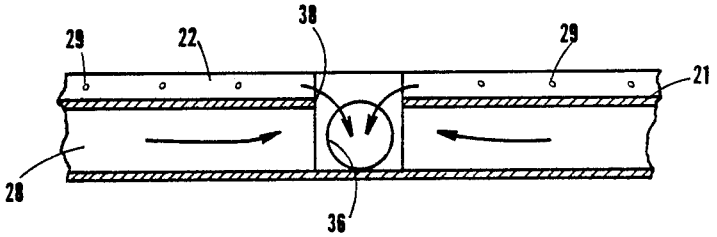
Fig. 6
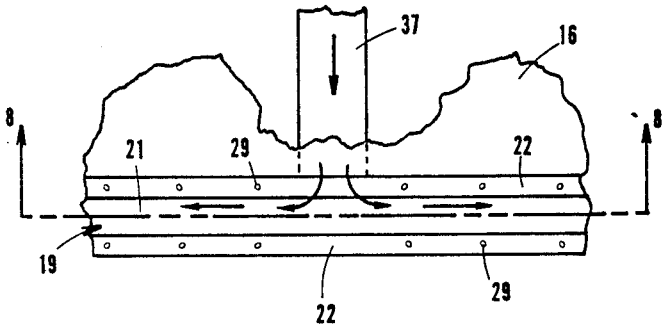
Fig. 7
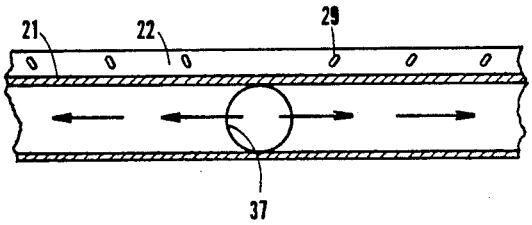
Fig. 8

BALL RETRIEVAL SYSTEM

This invention pertains generally to games such as table tennis and other games played with a ball, and more particularly to a system for retrieving balls outside the normal playing area of such games.

In games such as table tennis, much of the player's time can be spent in retrieving balls which go outside the normal playing area. This can be a particularly severe problem for persons who are physically handicapped or otherwise find it difficult to retrieve the balls, and it may prevent them from playing a game which they might otherwise enjoy. In some places, attendants retrieve the balls for the players, but this is a luxury which is not generally available to most people.

It is in general an object of the invention to provide a new and improved system for retrieving balls outside an area in which a game is normally played.

Another object of the invention is to provide a system of the above character which is particularly suitable for retrieving table tennis balls.

These and other objects are achieved in accordance with the invention by providing a ball retrieval system having a channel for receiving balls toward the periphery of a playing area, a ball receptacle positioned at a convenient location in the playing area, and means for pneumatically conveying the balls along the channel and from the channel to the ball receptor.

FIG. 4 is an enlarged sectional view of the area 4—4 in FIG. 1.

FIG. 5 is an enlarged plan view, partly broken away, of the area 5—5 in FIG. 2, rotated 90° in a clockwise direction relative to FIG. 2.

FIG. 6 is a cross-sectional view taken along line 6—6 in FIG. 5.

FIG. 7 is an enlarged plan view, partly broken away, of the area 7—7 in FIG. 2.

FIG. 8 is a cross-sectional view taken along line 8—8 in FIG. 7.

Figure 1:
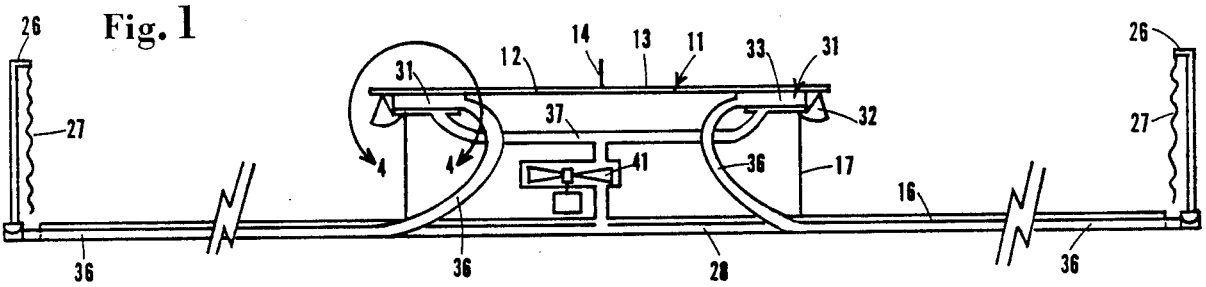
FIG. 1 is a vertical sectional view of a table tennis table with one embodiment of a ball retrieval system according to the invention.
Figure 2:
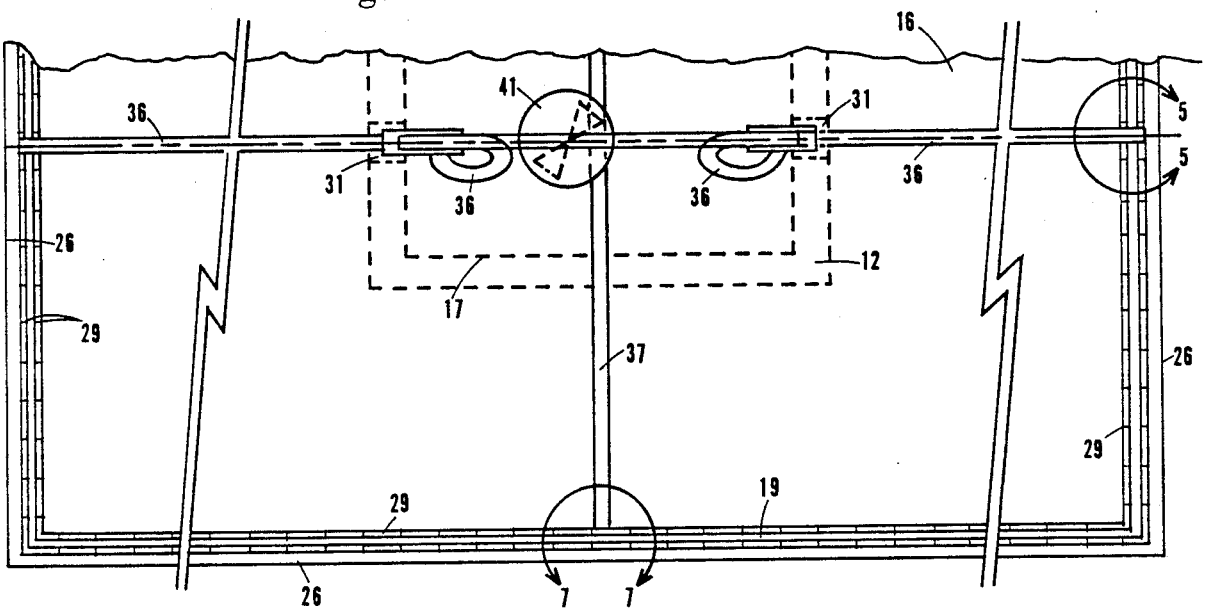
FIG. 2 is a fragmentary top plan view of the embodiment of FIG. 1.

In the drawings, the ball retrieval system is illustrated in connection with a table tennis table 11 having a generally rectangular top 12 with an upper playing surface 13 which is divided into two courts in the conventional manner by a net 14. The table is supported in a horizontal position above a floor 16 by a base or legs 17 of suitable design.

The ball retrieval system includes a channel 19 which extends peripherally about the playing area of floor 16 and is positioned below the upper surface of the floor. In one presently preferred embodiment, the floor is part of a raised platform, and the channel extends around the outer perimeter of the platform. However, the floor can be any other suitable supporting surface such as the ground or the the floor of a room, and the channel can be formed as a channel in the floor. The channel is open at the top and is adapted to receive balls hit off the table and out of play. The channel has a horizontally extending bottom wall 21 and a pair of downwardly and inwardly inclined side walls 22.

Figure 3:
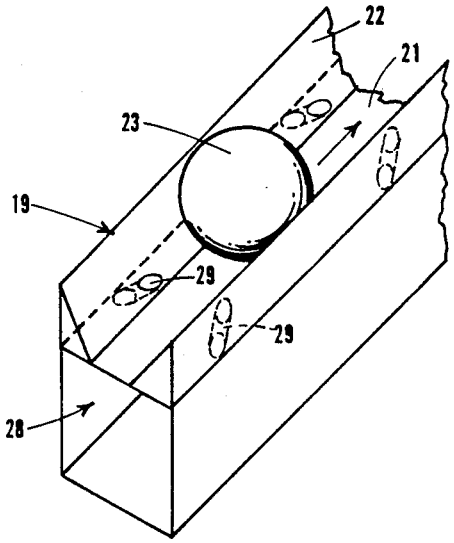
FIG. 3 is an enlarged fragmentary isometric view of the air duct and channel in the embodiment of FIG. 1.

As best seen in FIG. 3, the depth and width of the channel correspond to the diameter of a table tennis ball 23, and the ball can roll freely along the channel.

A fence 26 extends around the playing area just outside the channel and keeps the balls within the playing area. The fence includes a net 27 which is suspended above the channel for catching the balls and directing them into the channel.

An air duct 28 extends around the periphery of the playing area beneath the channel, with the top wall of the duct forming the bottom wall of the channel. Air passageways 29 extend from the duct through the side walls of the channel and form discharge nozzles for directing jets of air into the trough to propel the balls along the trough. The discharge nozzles are arranged in pairs on opposite sides of the channel, and they are spaced about two ball diameters apart along the length of the channel. The nozzles are upwardly and inwardly inclined so that the jets of air impinge upon the rear portion of the ball to propel it along the trough. In the embodiment illustrated, the nozzles are inclined in such manner that the balls travel toward the midpoints of the channel at the ends of the table.

Ball receptors 31 are mounted on the table beneath the playing surface toward the ends of the table within easy reach of the players at the table. Each of the ball receptors includes a tray 32 for holding the balls returned to the playing area and a chamber 33 which communicates with the air duct as described more fully hereinafter.

Ducts 36 extend from the midpoints of duct 28 at the ends of floor 16 to chamber 33, and duct 37 extends from chambers 33 to the midpoints of duct 28 at the sides of the floor. At the junctions between ducts 28 and 36, and opening 38 is formed in the wall between channel 19 and duct 28. These openings are large enough to permit the balls to drop from the channel into the air duct. Duct 36 has a circular cross-section of slightly larger diameter than the balls.

A blower 41 is connected to duct 37 for circulating air through the duct system. This blower can be any suitable type of blower or fan. The blower draws air into the system through openings 38 and ducts 36 and discharges the air through duct 28 and discharge nozzles 29. The operation of the blower is such that ducts 36, chambers 33, and the portion of duct 37 between chambers 33 and the blower are maintained at a negative pressure, i.e. a pressure less than the pressure of the surrounding atmosphere. Duct 28 and the portion of duct 37 between the blower and duct 28 are maintained at a positive pressure, a pressure greater than atmospheric pressure.

As best illustrated in FIG. 4, ball trays 32 are positioned toward the outer ends of chambers 33, and a hingedly mounted door 43 normally closes an opening between each of the chambers and the ball tray associated therewith. The door is normally held in a closed position by the pressure differential between chamber 33 and the atmosphere to which the tray is exposed. The door is moved to an open position by a ball impacting upon the door, which permits the ball to drop from the chamber into the tray. A baffle 44 separates ducts 36 and 37 within the chamber and guides the balls toward the door.

Operation and use of the ball retrieval system are as follows. When a game of table tennis is to be played, blower 41 is energized to circulate air through the duct system, with the air being drawn in through ducts 36 and discharged through duct 28 and the discharge nozzles 29 in channel 19. When a ball is hit out of play, it will either roll into the channel or impact upon net 27 and drop into the channel. Once in the channel, the ball is propelled along the channel by the air jets discharged by nozzles 29 toward one of the transfer points at the ends of the floor. When the ball reaches the transfer point, it drops through opening 38 into duct 28, whereupon it is drawn into duct 36 by the circulating air. The ball travels through duct 36 to chamber 33 where it impacts upon door 43 and drops into tray 32 ready to be put into play again.

It is apparent from the foregoing that a new and improved system for retrieving table tennis balls and the like has been provided. While only one presently preferred embodiment has been described in detail, as will be apparent to those familiar with the art, certain changes and modifications can be made without departing from the scope of the invention as defined by the following claims.

I claim:

1. In combination: a table tennis table, a ball receptor positioned near one end of the table, a ball receiving channel extending peripherally around an area in which the table is located, means for conveying table tennis balls along the channel toward a transfer point, and means for conveying table tennis balls from the transfer point to the receptor.

2. The combination of claim 1 wherein the means for conveying the balls along the channel includes means for directing jets of air into the channel to propel the balls toward the transfer point.

3. The combination of claim 1 wherein the means for conveying the balls from the transfer point to the receptor comprises an air duct extending between the transfer point and the receptor, and means for circulating air through the duct to carry the balls toward the receptor.

4. The combination of claim 3 wherein the ball receptor includes a tray and a door which is normally held in a closed position by a difference in air pressure between the tray and the duct and can be moved to an open position by the impact of a ball upon the door.

5. The combination of claim 3 wherein the duct also extends from the ball receptor to the channel and along the channel to the transfer point, the means for conveying balls along the channel includes a plurality of air discharge nozzles extending between the duct and the channel, and the means for circulating air throught the duct comprises a blower connected to the duct between the ball receptor and the transfer point for drawing air into the duct from the transfer point and discharging air into the duct toward the channel.

6. The combination of claim 1 including a peripheral fence adjacent to the channel for directing the balls into the channel.

7. The combination of claim 1 wherein the means for conveying the balls along the channel and to the receptor include a plurality of nozzles spaced along the channel, a duct extending between the transfer point and the receptor, and a single blower for supplying air to the nozzles and circulating air through the duct to convey the balls along the channel and through the duct.

8. In combination: a table tennis table having a playing surface spaced above a floor, a channel positioned below the upper surface of the floor, surrounding the table for receiving balls hit out of play from the table, a receptor for balls positioned near one end of the table, an air duct extending along the channel and from a transfer point on the channel to the ball receptor and from the ball receptor to a return point along the channel, an opening at the transfer point through which balls can pass from the channel to the duct, a plurality of nozzles extending between the duct and the channel for discharging jets of air from the duct into the channel to propel the balls along the channel toward the transfer point, and a blower connected to the duct between the ball receptor and the return point for drawing air into the duct from the transfer point and discharging air into the duct toward the return point and the discharge nozzles.

9. The combination of claim 8 wherein the ball receptor includes a tray and a door which is normally held in a closed position by a difference in air pressure between the tray and the duct and can be moved to an open position by the impact of a ball upon the door.

10. The combination of claim 8 including a fence adjacent to the channel for directing the balls hit out of play into the channel.

11. In a ball retrieval system for returning balls to a predetermined location in a playing area: a ball receptor at the predetermined location, a channel for receiving balls from the playing area, an air duct extending along the channel and from a transfer point on the channel to the ball receptor and from the ball receptor to a return point along the channel, an opening at the transfer point through which balls can pass from the channel to the duct, a plurality of nozzles extending between the duct and the channel for discharging jets of air from the duct into the channel to propel the balls along the channel toward the transfer point, and a blower connected to the duct between the ball receptor return and the return point for drawing air into the duct from the transfer point and discharging air into the duct toward the return point and the discharge nozzles.

12. In a ball retrieval system for returning balls to a playing area: a ball receptor in the playing area, a channel for receiving balls from the playing area, a plurality of nozzles for directing jets of air into the channel to propel the balls along the channel toward a transfer point, a duct extending between the transfer point and the ball receptor, and means including a blower for discharging air through the nozzles to propel the balls toward the transfer point and drawing air through the duct from the transfer point toward the receptor to carry the balls from the transfer point toward the receptor said channel being continuous except at said transfer point.

13. The system of claim 12 including a ball receptor at the predetermined location, an opening between the air duct and the receptor, and a door movable between open and closed positions with regard to the opening, means for yieldably holding said door in a closed position 1 said door tray being moved to an open position by the impact of a ball on the door.

14. The system of claim 12 including a fence positioned near the perimeter of the playing area for directing balls into the channel.

* * * * *